US005592812A

United States Patent [19]

Hinshaw et al.

[11] Patent Number: 5,592,812

[45] Date of Patent: Jan. 14, 1997

[54] METAL COMPLEXES FOR USE AS GAS GENERANTS

[75] Inventors: Jerald C. Hinshaw, Farr West; Daniel W. Doll, North Ogden; Reed J. Blau, Richmond; Gary K. Lund, Ogden, all of Utah

[73] Assignee: Thiokol Corporation, Ogden, Utah

[21] Appl. No.: 599,634

[22] Filed: Feb. 9, 1996

Related U.S. Application Data

[63] Continuation of Ser. No. 184,456, Jan. 19, 1994, abandoned.

[51] Int. Cl.[6] ..... C06D 5/00

[52] U.S. Cl. ..... 60/205; 149/36; 149/45; 149/46; 149/61; 149/75; 149/76; 149/77; 60/219; 280/741

[58] Field of Search ..... 60/205, 219; 149/36, 149/45, 46, 61, 75, 76, 77; 280/741

[56] References Cited

U.S. PATENT DOCUMENTS

| | | | |
|---|---|---|---|
| H464 | 5/1988 | Lee et al. | 102/364 |
| 147,871 | 2/1874 | Shaw . | |
| 1,399,954 | 12/1921 | Fulton . | |
| 2,220,891 | 11/1940 | Cook | 149/46 |
| 2,483,803 | 10/1949 | Bridgman et al. | 73/15.4 |
| 2,981,616 | 4/1961 | Boyer | 52/5 |
| 3,010,815 | 11/1961 | Pierce et al. | 52/5 |
| 3,066,139 | 11/1962 | Zhivadinovich et al. | 260/242 |
| 3,122,462 | 2/1964 | Kaufman et al. | 149/35 |
| 3,405,068 | 10/1968 | Hiltz | 252/182 |
| 3,447,955 | 6/1969 | Hiltz | 252/4 |
| 3,450,414 | 6/1969 | Kobori | 280/150 |
| 3,463,684 | 8/1969 | Dehn | 149/45 |
| 3,664,898 | 5/1972 | Taylor et al. | 149/41 |
| 3,673,015 | 6/1972 | Sollott et al. | 149/45 |
| 3,674,059 | 7/1972 | Stephenson | 141/4 |
| 3,711,115 | 1/1973 | Lohr | 280/150 AB |
| 3,723,205 | 3/1973 | Scheffee | 149/19 |
| 3,741,585 | 6/1973 | Hendrickson et al. | 280/150 |
| 3,773,351 | 11/1973 | Catanzarite | 280/150 AB |
| 3,773,352 | 11/1973 | Radke | 280/150 AB |
| 3,773,947 | 11/1973 | Boyars et al. | 423/351 |
| 3,775,182 | 12/1973 | Marshall | 252/188.3 |
| 3,779,823 | 12/1973 | Price et al. | 149/19 |
| 3,785,149 | 1/1974 | Timmerman | 60/205 |
| 3,787,074 | 1/1974 | Lewis et al. | 280/150 AB |
| 3,791,302 | 2/1974 | Mcleod | 102/70.2 |
| 3,806,461 | 4/1974 | Hendrickson et al. | 252/188.3 R |
| 3,810,655 | 5/1974 | Pracher | 280/150 AB |
| 3,814,694 | 6/1974 | Klager | 252/186 |
| 3,827,715 | 8/1974 | Lynch | 280/150 AB |
| 3,833,029 | 9/1974 | Munn | 141/4 |
| 3,833,432 | 9/1974 | Moy et al. | 149/19.3 |
| 3,837,942 | 9/1974 | Catanzarite | 149/83 |
| 3,862,866 | 1/1975 | Timmerman et al. | 149/21 |
| 3,868,124 | 2/1975 | Johnson | 280/150 AB |
| 3,880,447 | 4/1975 | Thorn et al. | 280/150 AB |
| 3,880,595 | 4/1975 | Timmerman | 23/281 |
| 3,883,373 | 5/1975 | Sidebottom | 149/6 |
| 3,895,098 | 7/1975 | Pietz | 423/351 |
| 3,897,235 | 7/1975 | Hamilton et al. | 149/41 |
| 3,901,747 | 8/1975 | Garner | 149/42 |
| 3,902,934 | 9/1975 | Timmerman | 149/83 |
| 3,910,805 | 10/1975 | Catanzarite | 149/83 |
| 3,912,458 | 10/1975 | Fukuma et al. | 23/281 |
| 3,912,561 | 10/1975 | Doin et al. | 149/35 |
| 3,912,562 | 10/1975 | Garner | 149/41 |
| 3,931,040 | 1/1976 | Breazeale | 252/188.3 R |
| 3,933,543 | 1/1976 | Madden | 149/21 |
| 3,934,984 | 1/1976 | Marlow et al. | 23/281 |
| 3,936,330 | 2/1976 | Dergazarian et al. | 149/35 |
| 3,947,300 | 3/1976 | Passauer et al. | 149/35 |
| 3,950,009 | 4/1976 | Hamilton | 280/150 AB |
| 3,964,255 | 6/1976 | Catanzarite | 60/205 |
| 3,971,729 | 7/1976 | Timmerman | 252/187 R |
| 3,996,079 | 12/1976 | Divalentin | 149/35 |
| 4,021,275 | 5/1977 | Kishi et al. | 149/35 |
| 4,053,567 | 10/1977 | Franz | 149/36 |
| 4,062,708 | 12/1977 | Goetz | 149/35 |
| 4,114,591 | 9/1978 | Nakagawa | 126/263 |
| 4,124,515 | 11/1978 | Gruner et al. | 252/62 |
| 4,128,996 | 12/1978 | Garner et al. | 60/205 |

(List continued on next page.)

OTHER PUBLICATIONS

Hawley, ed. "*The Condensed Chemical Dictionary*", 9th Ed., p. 227, Van Nostrand Reinhold Co. (1977) New York.

"mer–and fac–[$Co(NH_3)_3$ $(NO_2)_3$]: Do They Exist?", Michael Laing, *Journal of Chemical Education*, vol. 62, No. 8, Aug. 1985, pp. 707–708.

"μ–Carboxylatodi–μ–Hydroxo–bis[triamminecobalt (III)] Complexes", K. Wieghardt and H. Siebert, *Inorganic Synthesis*, 23, 1985, pp. 107–117.

"Synthesis and Characterisation of Metal Hydrazine Nitrate, Azide and Perchlorate Complexes", K. C. Patil, C. Nesamani, V. R. Pai Verneker, *Synthesis and Reactivity in Inorganic and Metal Organic Chemistry*, 23 (4), 1982, pp. 383–395.

"Isomere des Trinitrotriamminkobalt (III)", Von H. Siebert, *Z. Annorg. Allg. Chem.* 441, 1978, pp. 47–57.

"The Triamines of Cobalt (III). I. Geometrical Isomers of Trinitrotriamminecobalt (III)", Robert B. Hagel and Leonard F. Druding, *Inorganic Chemistry*, vol. 9, No. 6, Jun. 1970, pp. 1496–1503.

"Preparation of Some Hydrazine Compounds of Palladium", N. G. Klyuchnikov and F. I. Para, *Russian Journal of Inorganic Chemistry*, 13 (3), pp. 416–418.

*Primary Examiner*—Edward A. Miller

*Attorney, Agent, or Firm*—Madson & Metcalf; Ronald L. Lyons

[57] ABSTRACT

Gas generating compositions and methods for their use are provided. Metal complexes are used as gas generating compositions. These complexes are comprised of a cationic metal template, sufficient oxidizing anion to balance the charge of the complex, and a neutral ligand containing hydrogen and nitrogen. The complexes are formulated such that when the complex combusts nitrogen gas and water vapor is produced. Specific examples of such complexes include metal nitrite ammine, metal nitrate ammine, and metal perchlorate ammine complexes, as well as hydrazine complexes. Such complexes are adaptable for use in gas generating devices such as automobile air bags.

22 Claims, No Drawings

U.S. PATENT DOCUMENTS

| | | | |
|---|---|---|---|
| 4,152,891 | 5/1979 | Garner | 60/205 |
| 4,157,648 | 6/1979 | Brennan et al. | 60/205 |
| 4,179,327 | 12/1979 | Seldner | 156/667 |
| 4,200,615 | 4/1980 | Hamilton et al. | 422/166 |
| 4,203,786 | 5/1980 | Garner | 149/19.91 |
| 4,203,787 | 5/1980 | Kirchoff et al. | 149/35 |
| 4,214,438 | 7/1980 | Hamilton et al. | 60/205 |
| 4,238,253 | 12/1980 | Garner | 149/19 |
| 4,244,758 | 1/1981 | Garner et al. | 149/7 |
| 4,246,051 | 1/1981 | Garner et al. | 149/7 |
| 4,298,412 | 11/1981 | Biddle et al. | 149/19.5 |
| 4,306,499 | 12/1981 | Holmes | 102/202.4 |
| 4,336,085 | 6/1982 | Walker et al. | 149/45 |
| 4,339,288 | 7/1982 | Camp | 149/8 |
| 4,369,079 | 1/1983 | Shaw | 149/2 |
| 4,370,181 | 1/1983 | Lundstrom et al. | 149/2 |
| 4,370,930 | 2/1983 | Strasser et al. | 102/530 |
| 4,376,002 | 3/1983 | Utracki | 149/35 |
| 4,390,380 | 6/1983 | Camp | 149/8 |
| 4,407,119 | 10/1983 | Biddle et al. | 60/219 |
| 4,414,902 | 11/1983 | Strasser et al. | 102/531 |
| 4,424,086 | 1/1984 | Christopher | 149/19.3 |
| 4,484,960 | 11/1984 | Rucker | 149/22 |
| 4,533,416 | 8/1985 | Poole | 149/35 |
| 4,547,235 | 10/1985 | Schneiter et al. | 149/35 |
| 4,547,342 | 10/1985 | Adams et al. | 422/166 |
| 4,578,247 | 3/1986 | Bolieau | 422/165 |
| 4,590,860 | 5/1986 | Kromrey | 102/289 |
| 4,604,151 | 8/1986 | Knowlton et al. | 149/35 |
| 4,632,714 | 12/1986 | Abegg et al. | 149/45 |
| 4,664,033 | 5/1987 | Burkdoll et al. | 102/275.2 |
| 4,690,063 | 9/1987 | Granier et al. | 102/530 |
| 4,696,705 | 9/1987 | Hamilton | 149/21 |
| 4,698,107 | 10/1987 | Goetz et al. | 149/7 |
| 4,699,400 | 10/1987 | Adams et al. | 280/731 |
| 4,734,141 | 3/1988 | Cartwright et al. | 149/35 |
| 4,758,287 | 7/1988 | Pietz | 149/2 |
| 4,798,142 | 1/1989 | Canterberry et al. | 102/290 |
| 4,806,180 | 2/1989 | Goetz et al. | 149/5 |
| 4,833,996 | 5/1989 | Hayashi et al. | 102/530 |
| 4,834,817 | 5/1989 | Zeuner et al. | 149/35 |
| 4,834,818 | 5/1989 | Kazumi et al. | 149/35 |
| 4,865,667 | 9/1989 | Zeuner et al. | 149/22 |
| 4,890,860 | 1/1990 | Schnieter | 280/741 |
| 4,909,549 | 3/1990 | Poole et al. | 280/738 |
| 4,919,897 | 4/1990 | Bender et al. | 422/165 |
| 4,925,600 | 5/1990 | Hemmel et al. | 149/109.6 |
| 4,931,111 | 6/1990 | Poole et al. | 149/35 |
| 4,931,112 | 6/1990 | Wardle et al. | 149/88 |
| 4,948,439 | 8/1990 | Poole et al. | 149/46 |
| 4,950,458 | 8/1990 | Cunningham | 422/164 |
| 4,959,011 | 9/1990 | Nilsson | 431/263 |
| 4,963,203 | 10/1990 | Halcomb et al. | 149/37 |
| 4,981,534 | 1/1991 | Scheffe | 149/19.91 |
| 4,982,664 | 1/1991 | Norton | 102/272 |
| 4,998,751 | 3/1991 | Paxton et al. | 280/741 |
| 5,003,887 | 4/1991 | Unterforsthuber et al. | 102/531 |
| 5,004,586 | 4/1991 | Hayashi et al. | 422/164 |
| 5,005,486 | 4/1991 | Lenzen | 102/531 |
| 5,015,309 | 5/1991 | Wardle et al. | 149/19.1 |
| 5,015,311 | 5/1991 | Ramaswamy | 149/42 |
| 5,019,192 | 5/1991 | Ramaswamy | 149/42 |
| 5,019,220 | 5/1991 | Taylor et al. | 264/3.4 |
| 5,022,674 | 6/1991 | Frantom et al. | 280/741 |
| 5,024,160 | 6/1991 | Canterberry et al. | 102/323 |
| 5,031,932 | 7/1991 | Frantom et al. | 102/323 |
| 5,033,390 | 7/1991 | Minert et al. | 102/530 |
| 5,043,030 | 8/1991 | Ramaswamy | 149/16 |
| 5,046,429 | 9/1991 | Swann et al. | 102/530 |
| 5,052,817 | 10/1991 | Bement et al. | 374/8 |
| 5,060,973 | 10/1991 | Giovanetti | 280/736 |
| 5,062,365 | 11/1991 | Canterberry | 102/322 |
| 5,062,367 | 11/1991 | Hayashi et al. | 102/530 |
| 5,073,273 | 12/1991 | Gupta et al. | 210/760 |
| 5,074,940 | 12/1991 | Ochi et al. | 149/35 |
| 5,089,069 | 2/1992 | Ramaswamy et al. | 149/21 |
| 5,094,475 | 3/1992 | Olsson et al. | 280/741 |
| 5,098,597 | 3/1992 | Rothgery et al. | 252/182.34 |
| 5,100,172 | 3/1992 | Vanvoorhies et al. | 280/738 |
| 5,100,174 | 3/1992 | Jasken et al. | 280/741 |
| 5,104,466 | 4/1992 | Allard et al. | 149/21 |
| 5,141,734 | 8/1992 | Misra | 423/580 |
| 5,160,386 | 11/1992 | Lund et al. | 149/45 |
| 5,212,343 | 5/1993 | Brupacher et al. | 102/323 |
| 5,266,132 | 11/1993 | Daren et al. | 149/37 |
| 5,516,377 | 5/1996 | Highsmith et al. | 149/18 |

METAL COMPLEXES FOR USE AS GAS GENERANTS

This application is a continuation of U.S. application Ser. No. 08/184,456, filed Jan. 19, 1994, for METAL COMPLEXES FOR USE AS GAS GENERANTS, now abandoned.

FIELD OF THE INVENTION

The present invention relates to complexes of transition metals or alkaline earth metals which are capable of combusting to generate gases. More particularly, the present invention relates to providing such complexes which rapidly oxidize to produce significant quantities of gases, particularly water vapor and nitrogen.

BACKGROUND OF THE INVENTION

Gas generating chemical compositions are useful in a number of different contexts. One important use for such compositions is in the operation of "air bags." Air bags are gaining in acceptance to the point that many, if not most, new automobiles are equipped with such devices. Indeed, many new automobiles are equipped with multiple air bags to protect the driver and passengers.

In the context of automobile air bags, sufficient gas must be generated to inflate the device within a fraction of a second. Between the time the car is impacted in an accident, and the time the driver would otherwise be thrust against the steering wheel, the air bag must fully inflate. As a consequence, nearly instantaneous gas generation is required.

There are a number of additional important design criteria that must be satisfied. Automobile manufacturers and others have set forth the required criteria which must be met in detailed specifications. Preparing gas generating compositions that meet these important design criteria is an extremely difficult task. These specifications require that the gas generating composition produce gas at a required rate. The specifications also place strict limits on the generation of toxic or harmful gases or solids. Examples of restricted gases include carbon monoxide, carbon dioxide, $NO_x$, $SO_x$, and hydrogen sulfide.

The gas must be generated at a sufficiently and reasonably low temperature so that an occupant of the car is not burned upon impacting an inflated air bag. If the gas produced is overly hot, there is a possibility that the occupant of the motor vehicle may be burned upon impacting a just deployed air bag. Accordingly, it is necessary that the combination of the gas generant and the construction of the air bag isolates automobile occupants from excessive heat. All of this is required while the gas generant maintains an adequate burn rate.

Another related but important design criteria is that the gas generant composition produces a limited quantity of particulate materials. Particulate materials can interfere with the operation of the supplemental restraint system, present an inhalation hazard, irritate the skin and eyes, or constitute a hazardous solid waste that must be dealt with after the operation of the safety device. In the absence of an acceptable alternative, the production of irritating particulates is one of the undesirable, but tolerated aspects of the currently used sodium azide materials.

In addition to producing limited, if any, quantities of particulates, it is desired that at least the bulk of any such particulates be easily filterable. For instance, it is desirable that the composition produce a filterable slag. If the reaction products form a filterable material, the products can be filtered and prevented from escaping into the surrounding environment. This also limits interference with the gas generating apparatus and the spreading of potentially harmful dust in the vicinity of the spent air bag which can cause lung, mucous membrane and eye irritation to vehicle occupants and rescuers.

Both organic and inorganic materials have been proposed as possible gas generants. Such gas generant compositions include oxidizers and fuels which react at sufficiently high rates to produce large quantities of gas in a fraction of a second.

At present, sodium azide is the most widely used and currently accepted gas generating material. Sodium azide nominally meets industry specifications and guidelines. Nevertheless, sodium azide presents a number of persistent problems. Sodium azide is relatively toxic as a starting material, since its toxicity level as measured by oral rat $LD_{50}$ is in the range of 45 mg/kg. Workers who regularly handle sodium azide have experienced various health problems such as severe headaches, shortness of breath, convulsions, and other symptoms.

In addition, no matter what auxiliary oxidizer is employed, the combustion products from a sodium azide gas generant include caustic reaction products such as sodium oxide, or sodium hydroxide. Molybdenum disulfide or sulfur have been used as oxidizers for sodium azide. However, use of such oxidizers results in toxic products such as hydrogen sulfide gas and corrosive materials such as sodium oxide and sodium sulfide. Rescue workers and automobile occupants have complained about both the hydrogen sulfide gas and the corrosive powder produced by the operation of sodium azide-based gas generants.

Increasing problems are also anticipated in relation to disposal of unused gas-inflated supplemental restraint systems, e.g. automobile air bags, in demolished cars. The sodium azide remaining in such supplemental restraint systems can leach out of the demolished car to become a water pollutant or toxic waste. Indeed, some have expressed concern that sodium azide might form explosive heavy metal azides or hydrazoic acid when contacted with battery acids following disposal.

Sodium azide-based gas generants are most commonly used for air bag inflation, but with the significant disadvantages of such compositions many alternative gas generant compositions have been proposed to replace sodium azide. Most of the proposed sodium azide replacements, however, fail to deal adequately with all of the criteria set forth above.

It will be appreciated, therefore, that there are a number of important criteria for selecting gas generating compositions for use in automobile supplemental restraint systems. For example, it is important to select starting materials that are not toxic. At the same time, the combustion products must not be toxic or harmful. In this regard, industry standards limit the allowable amounts of various gases produced by the operation of supplemental restraint systems.

It would, therefore, be a significant advance to provide compositions capable of generating large quantities of gas that would overcome the problems identified in the existing art. It would be a further advance to provide a gas generating composition which is based on substantially nontoxic starting materials and which produces substantially nontoxic reaction products. It would be another advance in the art to provide a gas generating composition which produces very limited amounts of toxic or irritating particulate debris and limited undesirable gaseous products. It would also be an advance to provide a gas generating composition which forms a readily filterable solid slag upon reaction.

Such compositions and methods for their use are disclosed and claimed herein.

SUMMARY AND OBJECTS OF THE INVENTION

The present invention is related to the use of complexes of transition metals or alkaline earth metals as gas generating compositions. These complexes are comprised of a cationic metal template, sufficient oxidizing anion to balance the charge of the complex, and a neutral ligand containing hydrogen and nitrogen. In some cases the oxidizing anion is coordinated with the metal template. The complexes are formulated such that when the complex combusts nitrogen gas and water vapor is produced. Importantly, the production of other undesirable gases is substantially eliminated.

Specific examples of such complexes include metal nitrite ammine, metal nitrate ammine, metal perchlorate ammine, and metal hydrazine complexes. The complexes within the scope of the present invention rapidly combust or decompose to produce significant quantities of gas.

The metals incorporated within the complexes are transition metals or alkaline earth metals that are capable of forming ammine or hydrazine complexes. The presently preferred metal is cobalt. Other metals which also form complexes with the properties desired in the present invention include, for example, magnesium, manganese, nickel, vanadium, copper, chromium and zinc. Examples of other usable metals include rhodium, iridium, ruthenium, palladium, and platinum. These metals are not as preferred as the metals mentioned above, primarily because of cost considerations.

The transition metal or alkaline earth metal acts as a template at the center of a nitrite ammine, nitrate ammine, perchlorate ammine, or hydrazine complex. An ammine complex is generally defined as a coordination complex including ammonia, whereas a hydrazine complex is similarly defined as a coordination complex containing hydrazine. Thus, examples of metal complexes within the scope of the present invention include $Cu(NH_3)_4(NO_3)_2$ (tetraamminecopper(II) nitrate) , $Co(NH_3)_3(NO_2)_3$ (trinitrotriamminecobalt (III)) , $CO(NH_3)_6(ClO_4)_3$ (hexaammine cobalt (III) perchlorate) , $Zn(N_2H_4)_3(NO_3)_2$ (tris-hydrazine zinc nitrate), $Mg(N_2H_4)_2(ClO_4)_2$ (bis-hydrazine magnesium perchlorate), and $Pt(NO_2)_2(NH_2NH_2)_2$ (bis-hydrazine platinum (II) nitrite).

It is observed that transition metal complexes of this type combust rapidly to produce significant quantities of gases. Combustion can be initiated by the application of heat or by the use of conventional igniter devices.

Some of the complexes of the present invention combust stoichiometrically to a metal or metal oxide, nitrogen and water. That is, it is not necessary to allow the complex to react with any other material in order to produce gas. In other cases, however, it is desirable to add a further oxidizing agent or fuel in order to accomplish efficient combustion and gas production. These materials are added in oxidizing or fuel effective quantities as needed.

DETAILED DESCRIPTION OF THE INVENTION

As discussed above, the present invention is related to the use of complexes of transition metals or alkaline earth metals as gas generating compositions. These complexes are comprised of a cationic metal template, sufficient oxidizing anion to balance the charge of the complex, and a neutral ligand containing hydrogen and nitrogen. In some cases the oxidizing anion is coordinated with the metal template. The complexes are formulated such that when the complex combusts, nitrogen gas and water vapor is produced. The combustion takes place at a rate sufficient to qualify such materials for use as gas generating compositions in automobile air bags and other similar types of devices. Importantly, the production of other undesirable gases is substantially eliminated.

Complexes which fall within the scope of the present invention include metal nitrate ammines, metal nitrite ammines, metal perchlorate ammines, and metal hydrazines. As mentioned above, ammine complexes are defined as coordination complexes including ammonia. Thus, the present invention relates to ammine complexes which also include one or more nitrite ($NO_2$) or nitrate ($NO_3$) groups in the complex. In certain instances, the complexes may include both nitrite and nitrate groups in a single complex. The present invention also relates to similar perchlorate ammine complexes, and metal complexes containing one or more hydrazine groups and corresponding oxidizing anions.

It is suggested that during combustion of a complex containing nitrite and ammonia groups, the nitrite and ammonia groups undergo a diazotization reaction. This reaction is similar, for example, to the reaction of sodium nitrite and ammonium sulfate, which is set forth as follows:

$$2NaNO_2+(NH_4)_2SO_4 \rightarrow Na_2SO_4+4H_2O+2N_2$$

Compositions such as sodium nitrite and ammonium sulfate in combination have little utility as gas generating substances. These materials are observed to undergo metathesis reactions which result in unstable ammonium nitrite. In addition, most simple nitrite salts have limited stability.

In contrast, the metal complexes of the present invention provide stable materials which are, in certain instances, still capable of undergoing the type of reaction set forth above. The complexes of the present invention also produce reaction products which include desirable quantities of nontoxic gases such as water vapor and nitrogen. In addition, a stable metal, or metal oxide slag is formed. Thus, the compositions of the present invention avoid several of the limitations of existing sodium azide gas generating compositions.

Any transition metal or alkaline earth metal which is capable of forming the complexes described herein is a potential candidate for use in these gas generating compositions. However, considerations such as cost, thermal stability, and toxicity may limit the most preferred group of metals.

The presently preferred metal is cobalt. Cobalt forms stable complexes which are relatively inexpensive. In addition, the reaction products of cobalt complex combustion are relatively non-toxic. Other preferred metals include magnesium, manganese, copper, and zinc. Examples of less preferred but usable metals include nickel, vanadium, chromium, rhodium, iridium, ruthenium, and platinum.

Examples of ammine complexes within the scope of the present invention, and the associated gas generating decomposition reactions are as follows:

$$Cu(NH_3)_2(NO_2)_2 \rightarrow CuO+3H_2O+2N_2$$

$$2Co(NH_3)_3(NO_2)_3 \rightarrow 2CoO+9H_2O+6N_2+\tfrac{1}{2}o_2$$

$$2Cr(NH_3)_3(NO_2)_3 \rightarrow Cr_2O_3+9H_2O+6N_2$$

$$2B+3Co(NH_3)_6Co(NO_2)_6 \rightarrow 3CoO+B_2O_3+27H_2O+18N_2$$

$$Mg+Co(NH_3)_4(NO_2)_2Co(NH_3)_2(NO_2)_4 \rightarrow 2Co+MgO+9H_2O+6N_2$$

$$5[Co(NH_3)_4(NO_2)_2](NO_2)+Sr(NO_3)_2 \rightarrow 5CoO+SrO+18N_2+30H_2O$$

$$4[Co(NH_3)_4(NO_2)_2]NO_2+2[Co(NH_3)_2(NO_3)_3] \rightarrow 6CoO+36H_2O+21N_2$$

Examples of hydrazine complexes within the scope of the present invention, and related gas generating reactions are as follows:

$$5Zn(N_2H_4)\ (NO_3)_2+Sr(NO_3)_2 \rightarrow 5ZnO+20N_2+30H_2O+SrO$$

$$CO\ (N_2H_4)_3(NO_3)_2 \rightarrow Co+3N_2+6H_2O$$

$$3Mg(N_2H_4)_2(ClO_4)_2+Si_3N_4 \rightarrow 3SiO_2+3MgCl_2+10N_2+12H_2O$$

$$2Mg(N_2H_4)_2(NO_3)_2+2[Co(NH_3)_4(NO_2)_2]NO_2 \rightarrow 2MgO+2CoO+13N_2+20H_2O$$

$$Pt(NO_2)_2(NH_2NH_2)_2 \rightarrow Pt+3N_2+4H_2O$$

While the complexes of the present invention are relatively stable, it is also simple to initiate the combustion reaction. For example, if the complexes are contacted with a hot wire, rapid gas producing combustion reactions are observed. Similarly, it is possible to initiate the reaction by means of conventional igniter devices. One type of igniter device includes a quantity of $BKNO_3$ pellets which is ignited, and which in turn is capable of igniting the compositions of the present invention.

It is also of importance to note that many of the complexes defined above undergo "stoichiometric" decomposition. That is, the complexes decompose without reacting with any other material to produce large quantities of gas, and a metal or metal oxide. However, for certain complexes it may be desirable to add a fuel or oxidizer to the complex in order to assure complete and efficient reaction. Such fuels include, for example, boron, magnesium, aluminum, hydrides of boron or aluminum, silicon, titanium, zirconium, and other similar conventional fuel materials such as conventional organic binders. Oxidizing species include nitrates, nitrites, chlorates, perchlorates, peroxides, and other similar oxidizing materials. Thus, while stoichiometric decomposition is attractive because of the simplicity of the composition and reaction, it is also possible to use complexes for which stoichiometric decomposition is not possible.

Examples of non-stoichiometric complexes include:

$Co(NH_3)_4(NO_2)_2X$ (where X is a monovalent anion)

$NH_4CO(NH_3)_2(NO_2)_4$

As mentioned above, nitrate and perchlorate complexes also fall within the scope of the invention. Examples of such nitrate complexes include:

$$Co(NH_3)_6(NO_3)_3$$

$$Cu(NH_3)_4(NO_3)_2$$

$$[Co(NH_3)_5(NO_3)](NO_3)_2$$

$$[Co(NH_3)_5(NO_2)](NO_3)_2$$

$$[Co(NH_3)_5(H_2O)](NO_3)_2$$

Examples of perchlorate complexes within the scope of the invention include:

$$[Co(NH_3)_6](ClO_4)_3$$

$$[Co(NH_3)_5(NO_2)]ClO_4$$

$$[Mg(N_2H_4)_2](ClO_4)_2$$

Preparation of metal nitrite or nitrate ammine complexes of the present invention is described in the literature. Specifically, reference is made to Hagel, "The Triamines of Cobalt (III). I. Geometrical Isomers of Trinitrotriamminecobalt(III)," 9 *Inorganic Chemistry* 1496 (June 1970); Shibata, et al. "Synthesis of Nitroammine- and Cyanoamminecobalt (III ) Complexes With Potassium Tricarbonatocobaltate(III) as the Starting Material," 3 *Inorganic Chemistry* 1573 (Nov. 1964); Wieghardt, "mu. -Carboxylatodi-.mu.-hydroxo-bis [triamminecobalt (III)] Complexes," 23 *Inorganic Synthesis* 23 (1985); Laing, "Mer- and fac-triamminetrinitrocobalt(III): Do they exist?" 62 *J. Chem Educ.*, 707 (1985); Siebert, "Isomers of Trinitrotriamminecobalt(III)," 441 *Z. Anorg. Allg. Chem.* 47 (1978); all of which are incorporated herein by this reference. Transition metal perchlorate ammine complexes are synthesized by similar methods. As mentioned above, the ammine complexes of the present invention are generally stable and safe for use in preparing gas generating formulations.

Preparation of metal perchlorate, nitrate, and nitrite hydrazine complexes is also described in the literature. Specific reference is made to Patil, et al. "Synthesis and Characterization of Metal Hydrazine Nitrate, Azide, and Perchlorate Complexes," 12 *Synthesis and Reactivity In Inorganic and Metal Organic Chemistry*, 383 (1982); Klyichnikov, et al. "Synthesis of Some Hydrazine Compounds of Palladium," 13 *Zh. Neorg. Khim.*, 792 (1968); Ibid., "Conversion of Mononuclear Hydrazine Complexes of Platinum and Palladium Into Binuclear Complexes," 36 *Ukr. Khim. Zh.*, 687 (1970).

The materials are also processible. The materials can be pressed into usable pellets for use in gas generating devices. Such devices include automobile air bag supplemental restraint systems. Such gas generating devices will comprise a quantity of the described complexes which can be defined generally as metal nitrite ammine, metal nitrate ammine, metal nitrite hydrazine, metal nitrate hydrazine, metal perchlorate ammine, and metal perchlorate hydrazine complexes wherein the metal is selected from the group consisting of transition metals. The complexes produce a mixture of gases, principally nitrogen-and water vapor, by the decomposition of the complex. The gas generating device will also include means for initiating the decomposition of the composition, such as a hot wire or igniter. In the case of an automobile air bag system, the system will include the complexes described above; a collapsed, inflatable air bag; and means for igniting said gas-generating composition within the air bag system. Automobile air bag systems are well known in the art.

The gas generating compositions of the present invention are readily adapted for use with conventional hybrid air bag inflator technology. Hybrid inflator technology is based on heating a stored inert gas (argon or helium) to a desired temperature by burning a small amount of propellant. Hybrid inflators do not require cooling filters used with pyrotechnic inflators to cool combustion gases, because hybrid inflators are able to provide a lower temperature gas. The gas discharge temperature can be selectively changed by adjusting the ratio of inert gas weight to propellant weight. The higher the gas weight to propellant weight ratio, the cooler the gas discharge temperature.

A hybrid gas generating system comprises a pressure tank having a rupturable opening, a pre-determined amount of inert gas disposed within that pressure tank; a gas generating device for producing hot combustion gases and having means for rupturing the rupturable opening; and means for igniting the gas generating composition. The tank has a rupturable opening which can be broken by a piston when the gas generating device is ignited. The gas generating device is configured and positioned relative to the pressure tank so that hot combustion gases are mixed with and heat the inert gas. Suitable inert gases include, among others, argon, and helium and mixtures thereof. The mixed and heated gases exit the pressure tank through the opening and ultimately exit the hybrid inflator and deploy an inflatable bag or balloon, such as an automobile airbag.

The high heat capacity of water vapor can be an added advantage for its use as a heating gas in a hybrid gas generating system. Thus, less water vapor, and consequently, less generant may be needed to heat a given quantity of inert gas to a given temperature. A preferred embodiment of the invention yields combustion products with a temperature in the range of greater than about 1800° K., the heat of which is transferred to the cooler inert gas causing a further improvement in the efficiency of the hybrid gas generating system.

Hybrid gas generating devices for supplemental safety restraint application are described in Frantom, Hybrid Airbag Inflator Technology, *Airbag Int'l Symposium on Sophisticated Car Occupant Safety Systems*, (Weinbrenner-Saal, Germany, Nov. 2–3, 1992).

EXAMPLES

The present invention is further described in the following non-limiting examples. Unless otherwise stated, the compositions are expressed in wt. %.

Example 1

A mixture of $2Co(NH_3)_3(NO_2)_3$ and $Co(NH_3)_4(NO_2)_2Co(NH_3)_2(NO_2)_4$ was prepared and pressed in a pellet having a diameter of approximately 0.504 inches. The complexes were prepared within the scope of the teachings of the Hagel, et al. reference identified above. The pellet was placed in a test bomb, which was pressurized to 1,000 psi with nitrogen gas.

The pellet was ignited with a hot wire and burn rate was measured and observed to be 0.38 inches per second. Theoretical calculations indicated a flame temperature of 1805° C. From theoretical calculations, it was predicted that the major reaction products would be solid CoO and gaseous reaction products. The major gaseous reaction products were predicted to be as follows:

| Product | Volume % |
|---|---|
| $H_2O$ | 57.9 |
| $N_2$ | 38.6 |
| $O_2$ | 3.1 |

Example 2

A quantity of $2Co(NH_3)_3(NO_2)_3$ was prepared according to the teachings of Example 1 and tested using differential scanning calorimetry. It was observed that the complex produced a vigorous exotherm at 200° C.

Example 3

Theoretical calculations were undertaken for $Co(NH_3)_3(NO_2)_3$. Those calculations indicated a flame temperature of about 2,000° K. and a gas yield of about 1.75 times that of a conventional sodium azide gas Venerating compositions based on equal volume of generating composition ("performance ratio").

Theoretical calculations were also undertaken for a series of gas generating compositions. The composition and the theoretical performance data is set forth below in Table I.

TABLE I

| Gas Generant | Ratio | Temp. (C.°) | Perf. Ratio |
|---|---|---|---|
| $Co(NH_3)_3(NO_2)_3$ | — | 1805 | 1.74 |
| $NH_4[Co(NH_3)_2(NO_2)_4]$ | — | 1381 | 1.81 |
| $NH_4[Co(NH_3)_2(NO_2)_4]/B$ | 99/1 | 1634 | 1.72 |
| $Co(NH_3)_6(NO_3)_3$ | — | 1585 | 2.19 |
| $[Co(NH_3)_5(NO_3)](NO_3)_2$ | — | 1637 | 2.00 |
| $[Fe(N_2H_4)_3](NO_3)_2/Sr(NO_3)_2$ | 87/13 | 2345 | 1.69 |
| $[Co(NH_3)_6](ClO_4)_3.CaH_2$ | 86/14 | 2577 | 1.29 |
| $[Co(NH_3)_5(NO_2)](NO_3)_2$ | — | 1659 | 2.06 |

Performance ratio is a normalized relation to a unit volume of azide-based gas generant. The theoretical gas yield for a typical sodium azide-based gas generant (68 wt. % $NaN_3$; 30 wt % of $MoS_2$; 2 wt % of S) is about 0.85 g gas/cc $NaN_3$ generant.

Example 4

Theoretical calculations were conducted on the reaction of $[Co(NH_3)_6](ClO_4)_3$ and $CaH_2$ as listed in Table I to evaluate its use in a hybrid gas generator. If this formulation is allowed to undergo combustion in the presence of 6.80 times its weight in argon gas, the flame temperature decreases from 2577° C. to 1085° C., assuming 100% efficient heat transfer. The output gases consist of 86.8% by volume argon, 1600 ppm by volume hydrogen chloride, 10.2% by volume water, and 2.9% by volume nitrogen. The total slag weight would be 6.1% by mass.

SUMMARY

In summary the present invention provides gas generating materials that overcome some of the limitations of conventional azide-based gas generating compositions. The complexes of the present invention produce non toxic gaseous products including water vapor, oxygen, and nitrogen. Certain of the complexes are also capable of stoichiometric decomposition to a metal or metal oxide, and nitrogen and water vapor. Accordingly, no other chemical species are required to drive the reaction. Finally, reaction temperatures and burn rates are within acceptable ranges.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What we claim is:

1. A method for inflating an inflatable air bag which comprises the steps of:

generating substantially non-toxic gas consisting essentially of nitrogen gas and water vapor by combusting an at least essentially azide-free composition adapted for generating gas for use in inflating an air bag which comprises a metal ammine complex having a metal cation of a transition metal or an alkaline earth metal, sufficient oxidizing anion to balance the charge of the complex, and a neutral ligand comprising ammonia; and inflating said air bag using said gas.

2. A method for inflating an inflatable air bag or balloon which comprises the steps of generating substantially non-toxic gas comprised of nitrogen gas and water vapor by combusting a gas generant composition which consists essentially of at least one metal ammine complex which contains a metal cation of a transition metal or an alkaline earth metal, sufficient oxidizing anion to balance the charge of the complex, and a neutral ligand comprising ammonia; and inflating said air bag or balloon using said gas.

3. An at least essentially azide-free method for deploying an inflatable air bag from a supplemental safety restraint system which contains said air bag and a gas generating device, which contains an least essentially azide-free gas generant composition, for generating gas which can be used for inflating said air bag, said method comprising the steps of:

generating substantially non-toxic gas consisting essentially of nitrogen gas and water vapor by combusting an at least essentially azide-free gas generant composition comprising a metal ammine complex which comprises a metal cation of a transition metal or alkaline earth metal, sufficient oxidizing anion to balance the charge of the complex, and a neutral ligand comprising ammonia; and inflating said air bag using said gas.

4. A method according to claim 3, wherein said method further comprises combining said generated gas with an inert gas and inflating said air bag with said combination of gases.

5. A method according to claim 3, wherein said air bag is inflated with said generated gas.

6. A method according to claim 3, 4 or 5, wherein said metal ammine complex is at least one member selected from the group consisting of metal ammine nitrites, metal ammine nitrates and metal ammine perchlorates.

7. A method according to claim 3, wherein said complex is a metal ammine nitrite.

8. A method according to claim 3, wherein said complex is a metal ammine nitrate.

9. A method according to claim 3, wherein said complex is a metal ammine perchlorate.

10. A method according to claim 1, 2 or 3, wherein said metal cation is a cation of a metal is selected from the group consisting of magnesium, manganese, nickel, vanadium, copper, chromium, zinc, rhodium, iridium, ruthenium, palladium, and platinum.

11. A method according to claim 1, 2, 3, 4, 5, 7 or 8, wherein said metal cation is of a metal selected from the group consisting of manganese, magnesium, cobalt and zinc.

12. A method according to claim 1, 2, 3, 4, 5, 7 or 8, wherein said metal cation is a cobalt cation.

13. A method according to claim 1, 2 or 3, wherein said metal ammine complex is at least one member selected from the group consisting of metal ammine nitrates, metal ammine nitrites, and metal ammine perchlorates, and said metal cation is of a metal selected from the group consisting of magnesium, manganese, nickel, vanadium, copper, chromium, zinc, rhodium, iridium, ruthenium, palladium, and platinum.

14. A method according to claim 3, 4 or 5, wherein said metal ammine complex comprises at least one complex represented by a formula selected from the group consisting of $[Co(NH_3)_4(NO_2)_2](NO_2)$, $Co(NH_3)_2(NO_3)_3$, $Co(NH_3)_4Co(NO_2)_6$, and $Co(NH_3)_3(NO_2)_3$.

15. A method according to claim 3, wherein the combustion of the complex is stoichiometric to a metal or metal oxide, nitrogen, and water.

16. A method according to claim 3, wherein said method further comprises initiating the combustion of the metal complex using heat.

17. A method according to claim 3, wherein said oxidizing anion is substantially free of carbon and said gas is substantially free of carbon dioxide and carbon monoxide.

18. A method according to claim 1, 2, or 3, wherein the combustion is capable of producing an excess of fuel, and wherein an effective amount of additional oxidizing agent is provided to effect complete and efficient combustion during said generating step.

19. A method according to claim 1, 2 or 3, wherein the combustion is capable of producing an excess of fuel, and wherein said gas generant composition includes an effective amount of additional oxidizing agent to effect complete and efficient combustion during said generating step, and said oxidizing agent is other than said metal ammine complex and is at least one member selected from the group consisting of nitrates, nitrites, chlorates, perchlorates, peroxides, and metal oxides.

20. A method according to claim 3, wherein said anion is coordinated with said transition metal.

21. A method according to claim 1, 2, or 3, wherein the combustion is capable of producing an excess of oxidizing species during the combustion, and wherein said gas generant composition includes an effective amount of additional fuel to effect complete and efficient combustion during said generating step.

22. An at least essentially azide-free method for deploying an inflatable air bag from a supplemental safety restraint system in a vehicle wherein said system includes a gas generating device, which contains an least essentially azide-free gas generant composition, for generating gas useful for inflating said air bag, said method comprising the steps of:

generating a substantially non-toxic gas consisting essentially of nitrogen gas and water vapor by igniting and combusting said gas generant composition, said gas generant composition consisting essentially of at least one metal ammine complex which comprises a metal cation of a transition metal or alkaline earth metal, sufficient oxidizing anion to balance the charge of the complex, and a neutral ligand comprising ammonia; and inflating said inflatable air bag using said gas.

* * * * *